US009127532B2

(12) United States Patent
Maida et al.

(10) Patent No.: US 9,127,532 B2
(45) Date of Patent: Sep. 8, 2015

(54) OPTICAL CASING COLLAR LOCATOR SYSTEMS AND METHODS

(75) Inventors: John L. Maida, Houston, TX (US); Etienne M. Samson, Cypress, TX (US); David P. Sharp, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/432,206

(22) Filed: Mar. 28, 2012

(65) Prior Publication Data

US 2013/0056202 A1 Mar. 7, 2013

Related U.S. Application Data

(63) Continuation-in-part of application No. 13/226,578, filed on Sep. 7, 2011.

(51) Int. Cl.

| | |
|---|---|
| ***E21B 47/092*** | (2012.01) |
| ***E21B 47/09*** | (2012.01) |
| ***E21B 47/12*** | (2012.01) |

(52) U.S. Cl.

CPC ..... *E21B 47/0905* (2013.01); *E21B 47/123* (2013.01)

(58) Field of Classification Search

CPC ..... E21B 47/00; E21B 47/09; E21B 47/0905; E21B 47/04; E21B 47/123; E21B 47/0006; E21B 47/12

USPC ..... 166/250.01, 254.2, 255.1, 65.1, 66.1

See application file for complete search history.

(56) References Cited

U.S. PATENT DOCUMENTS

| | | | | |
|---|---|---|---|---|
| 3,019,841 | A | | 2/1962 | Ternow et al. |
| 3,603,923 | A | | 9/1971 | Nelligan |
| 3,773,120 | A | * | 11/1973 | Stroud et al. ..... 175/4.55 |
| 3,789,292 | A | | 1/1974 | Bottoms |
| 3,893,021 | A | | 7/1975 | Meador et al. |
| 3,980,881 | A | * | 9/1976 | Veach et al. ..... 250/261 |
| 4,450,406 | A | | 5/1984 | Bobb |
| 4,785,247 | A | | 11/1988 | Meador et al. |
| 4,794,336 | A | | 12/1988 | Marlow et al. |

(Continued)

FOREIGN PATENT DOCUMENTS

| | | |
|---|---|---|
| WO | WO-20110193401 | 2/2011 |
| WO | WO-2013/141971 | 9/2013 |
| WO | WO-2013/147996 | 10/2013 |

OTHER PUBLICATIONS

Angelidis, Diogenes et al., "Optical Micromachined Pressure Sensor for Aerospace Applications", Optical Engineering, vol. 31, No. 8, (Aug. 1992), pp. 1636-1642.

(Continued)

*Primary Examiner* — Elizabeth Gitlin

(74) *Attorney, Agent, or Firm* — Krueger Iselin LLP

(57) ABSTRACT

Fiber optic enabled casing collar locator systems and methods include a wireline sonde or a coil tubing sonde apparatus configured to be conveyed through a casing string by a fiber optic cable. The sonde includes at least one permanent magnet producing a magnetic field that changes in response to passing a collar in the casing string, a coil that receives at least a portion of the magnetic field and provides an electrical signal in response to the changes in the magnetic field, and a light source that responds to the electrical signal to communicate light along an optical fiber to indicate passing collars.

21 Claims, 4 Drawing Sheets

(56) References Cited

U.S. PATENT DOCUMENTS

| | | | | |
|---|---|---|---|---|
| 4,904,940 | A | 2/1990 | Rempt | |
| 4,933,640 | A | 6/1990 | Kuckes | |
| 4,986,121 | A | 1/1991 | Luscombe | |
| 5,037,172 | A | 8/1991 | Hekman et al. | |
| 5,095,514 | A | 3/1992 | Curtis | |
| 5,204,619 | A | 4/1993 | Beigbeder et al. | |
| 5,208,652 | A * | 5/1993 | Sonobe et al. | 356/460 |
| 5,429,190 | A | 7/1995 | Kilgore et al. | |
| 5,626,192 | A | 5/1997 | Connell et al. | |
| 5,675,674 | A | 10/1997 | Weis | |
| 5,712,828 | A | 1/1998 | Luscombe et al. | |
| 5,754,284 | A | 5/1998 | Leblanc et al. | |
| 5,808,779 | A | 9/1998 | Weis | |
| 5,892,860 | A | 4/1999 | Maron et al. | |
| 5,898,517 | A | 4/1999 | Weis | |
| 5,943,293 | A | 8/1999 | Luscombe et al. | |
| 6,128,251 | A | 10/2000 | Erath et al. | |
| 6,137,621 | A | 10/2000 | Wu | |
| 6,160,762 | A | 12/2000 | Luscombe et al. | |
| 6,188,645 | B1 | 2/2001 | Maida et al. | |
| 6,188,646 | B1 | 2/2001 | Luscombe et al. | |
| 6,195,162 | B1 | 2/2001 | Varnham et al. | |
| 6,211,964 | B1 | 4/2001 | Luscombe et al. | |
| 6,233,746 | B1 | 5/2001 | Skinner | |
| 6,256,588 | B1 | 7/2001 | Maida et al. | |
| 6,268,911 | B1 | 7/2001 | Tubel et al. | |
| 6,307,809 | B1 | 10/2001 | Luscombe et al. | |
| 6,408,943 | B1 | 6/2002 | Schultz et al. | |
| 6,422,084 | B1 | 7/2002 | Fernald et al. | |
| 6,522,797 | B1 | 2/2003 | Siems et al. | |
| 6,591,025 | B1 | 7/2003 | Siems et al. | |
| 6,731,389 | B2 | 5/2004 | Luscombe et al. | |
| 6,789,621 | B2 | 9/2004 | Wetzel et al. | |
| 6,834,233 | B2 | 12/2004 | Economides et al. | |
| 6,847,034 | B2 | 1/2005 | Shah et al. | |
| 6,853,604 | B2 | 2/2005 | Spackman et al. | |
| 6,896,056 | B2 | 5/2005 | Mendez et al. | |
| 6,907,170 | B1 | 6/2005 | Maida | |
| 6,913,083 | B2 | 7/2005 | Smith | |
| 6,931,188 | B2 | 8/2005 | Kersey et al. | |
| 6,957,574 | B2 | 10/2005 | Ogle | |
| 7,006,918 | B2 | 2/2006 | Economides et al. | |
| 7,077,200 | B1 * | 7/2006 | Adnan et al. | 166/250.01 |
| 7,095,012 | B2 | 8/2006 | Fujisawa et al. | |
| 7,104,324 | B2 | 9/2006 | Wetzel et al. | |
| 7,133,582 | B1 | 11/2006 | Moslehi et al. | |
| 7,140,435 | B2 | 11/2006 | Defretin et al. | |
| 7,159,468 | B2 | 1/2007 | Skinner et al. | |
| 7,163,055 | B2 | 1/2007 | Coon et al. | |
| 7,182,134 | B2 | 2/2007 | Wetzel et al. | |
| 7,195,033 | B2 | 3/2007 | Mayeu et al. | |
| 7,216,710 | B2 | 5/2007 | Welton et al. | |
| 7,219,729 | B2 | 5/2007 | Bostick, III et al. | |
| 7,219,730 | B2 | 5/2007 | Tilton et al. | |
| 7,245,791 | B2 | 7/2007 | Rambow et al. | |
| 7,408,645 | B2 | 8/2008 | DiFoggio | |
| 7,409,858 | B2 | 8/2008 | Dria et al. | |
| 7,413,011 | B1 * | 8/2008 | Chee et al. | 166/250.01 |
| 7,458,273 | B2 | 12/2008 | Skinner et al. | |
| 7,461,547 | B2 | 12/2008 | Terabayashi et al. | |
| 7,511,823 | B2 | 3/2009 | Schultz et al. | |
| 7,529,434 | B2 | 5/2009 | Taverner et al. | |
| 7,617,873 | B2 | 11/2009 | Lovell et al. | |
| 7,641,395 | B2 | 1/2010 | Ringgenberg et al. | |
| 7,665,543 | B2 | 2/2010 | Bostick, III et al. | |
| 7,669,440 | B2 | 3/2010 | Kersey et al. | |
| 7,854,267 | B2 | 12/2010 | Smith et al. | |
| 7,864,321 | B2 | 1/2011 | Caron et al. | |
| 7,900,699 | B2 | 3/2011 | Ramos et al. | |
| 7,938,178 | B2 | 5/2011 | Maida et al. | |
| 8,035,393 | B2 | 10/2011 | Tenghamn et al. | |
| 8,074,713 | B2 | 12/2011 | Ramos et al. | |
| 8,135,541 | B2 | 3/2012 | Davis et al. | |
| 8,274,400 | B2 | 9/2012 | Wilson et al. | |
| 2003/0127232 | A1 | 7/2003 | Bussear et al. | |
| 2003/0205375 | A1 | 11/2003 | Wright et al. | |
| 2003/0210403 | A1 | 11/2003 | Luscombe et al. | |
| 2004/0165809 | A1 | 8/2004 | Kersey et al. | |
| 2005/0072678 | A1 | 4/2005 | Hunter et al. | |
| 2005/0169794 | A1 | 8/2005 | Welton et al. | |
| 2005/0207279 | A1 | 9/2005 | Chemali et al. | |
| 2005/0247082 | A1 | 11/2005 | Kersey et al. | |
| 2005/0271107 | A1 * | 12/2005 | Murakami et al. | 372/50.1 |
| 2006/0081412 | A1 | 4/2006 | Wright et al. | |
| 2006/0157239 | A1 | 7/2006 | Ramos et al. | |
| 2007/0010404 | A1 | 1/2007 | Welton et al. | |
| 2007/0107573 | A1 | 5/2007 | Weusthof et al. | |
| 2007/0126594 | A1 | 6/2007 | Atkinson et al. | |
| 2007/0187648 | A1 | 8/2007 | Welton et al. | |
| 2007/0194948 | A1 * | 8/2007 | Hall et al. | 340/854.8 |
| 2008/0227668 | A1 | 9/2008 | Welton et al. | |
| 2008/0227669 | A1 | 9/2008 | Welton | |
| 2008/0280789 | A1 | 11/2008 | Welton et al. | |
| 2009/0058422 | A1 | 3/2009 | Tenghamn et al. | |
| 2009/0120640 | A1 | 5/2009 | Kulakofsky et al. | |
| 2009/0143258 | A1 | 6/2009 | Welton et al. | |
| 2009/0271115 | A1 | 10/2009 | Davis et al. | |
| 2010/0158435 | A1 | 6/2010 | Kersey et al. | |
| 2010/0309750 | A1 | 12/2010 | Brady | |
| 2011/0084696 | A1 | 4/2011 | Tenghamn et al. | |
| 2011/0090496 | A1 | 4/2011 | Samson et al. | |
| 2011/0100629 | A1 | 5/2011 | Welton et al. | |
| 2011/0105368 | A1 | 5/2011 | Welton et al. | |
| 2011/0109912 | A1 | 5/2011 | Spross et al. | |
| 2011/0116099 | A1 | 5/2011 | Spross et al. | |
| 2011/0139447 | A1 | 6/2011 | Ramos et al. | |
| 2011/0308788 | A1 | 12/2011 | Ravi et al. | |
| 2012/0013482 | A1 | 1/2012 | Patel et al. | |
| 2012/0013893 | A1 | 1/2012 | Maida et al. | |
| 2012/0250017 | A1 | 10/2012 | Morys et al. | |
| 2013/0056202 | A1 | 3/2013 | Maida et al. | |
| 2013/0249705 | A1 | 9/2013 | Sharp et al. | |

OTHER PUBLICATIONS

Aratani, K. "Process and Design Considerations for Surface Micromachined Beams for a Tuneable Interferometer Array in Silicon", IEEE Xplore, IEEE, 1993., pp. 230-235.

Hebb, Malcolm H., et al., "Tunnel Diodes", General Electric Research Laboratory, Nov. 1959, 27 pgs., Research Information Services, Schenectady, NY, USA., 27 pgs.

Johnson, R. L., et al., "Miniature Instrument for the Measurement of Gap Thickness Using Poly-Chromatic Interferometry", Center for Astronomical Adaptive Optics, Steward Observatory, The University of Arizona, Tucson, AZ, (Unknown), 9 pgs.

MacDougall, Trevor W., et al., "Large Diameter Waveguide Bragg Grating Components and Their Application in Downhole Oil & Gas Sensing", Weatherford International, Wallingford, CT, (Unknown), 12 pgs.

Maida, John L., et al., "Optical Casing Collar Locator Systems and Methods", U.S. Appl. No. 13/226,578, filed Sep. 7, 2011, 26 pgs.

Putty, Michael W., et al., "Process Integration for Active Polysilicon Resonant Microstructures", Sensors and Actuators, 20, (1989), pp. 143-151.

Tseng, Fan-Gang et al., "Polymer MEMS-Based Fabry-Perot Shear Stress Sensor", IEEE Sensors Journal, vol. 3, No. 6, (Dec. 2003), pp. 812-817.

Tudor, M.J. et al., "Silicon Resonator Sensors: Interrogation Techniques and Characteristics", IEE Proceedings, vol. 135, Pt. D, No. 5, (Sep. 1988), pp. 364-368.

Unknown, "Optical Activation of a Silicon Vibrating Sensor", Electronic Letters, vol. 22, No. 21, (Oct. 9, 1986), pp. 1097-1099.

Zhang, Wei et al., "Method to Increase the Number of Filters per Optical Path in a Downhole Spectrometer", PCT Appl No. PCT/US11/03655, filed May 24, 2011, 12 pgs.

"International Search Report and Written Opinion", dated Nov. 27, 2012, Appl No. PCT/US2012/054284, "Optical Casing Collar Locator Systems and Methods", filed Sep. 7, 2012, 21 pgs.

"PCT International Preliminary Report on Patentability", dated Jun. 27, 2013, Appl No. PCT/US2012/054284, "Optical Casing Collar Locator Systems and Methods", filed Sep. 7, 2012, 5 pgs.

(56) References Cited

OTHER PUBLICATIONS

"PCT International Search Report and Written Opinion", Dated Nov. 18, 2013, Appl No. PCT/US2013/024852, "Optical Casing Collar Locator Systems and Methods," filed Feb. 6, 2013, 9 pgs.
"PCT International Search Report and Written Opinion", Dated Nov. 18, 2013 Appl No. PCT/US2013/024849, "Casing Collar Locator with Wireless Telemetry Support," filed Feb. 6, 2013, 9 pgs.
U.S. Appl. No. 13/426,414, "Casing Collar Locator with Wireless Telemetry Support", filed Mar. 21, 2012, 23 pgs.
"US Non-Final Office Action", dated Oct. 7, 2013, U.S. Appl. No. 13/226,578, "Optical Casing Collar Locator Systems and Methods", filed Sep. 7, 2011, 10 pgs.
"US Non-Final Office Action", dated Sep. 29, 2014, U.S. Appl. No. 13/426,414, "Casing Collar Locator with Wireless Telemetry Support," filed Mar. 21, 2012, 17 pgs.
"IPRP", Dated Apr. 15, 2014, Appl No. PCT/US2013/024849, "Casing Collar Locator with Wireless Telemetry Support," Filed Feb. 6, 2013, 7 pgs.
"IPRP", Dated Apr. 15, 2014, Appl No. PCT/US2013/024852, "Optical Casing Collar Locator Systems and Methods," Filed Feb. 6, 2013, 17 pgs.
"US Final Office Action", Dated Jun. 27, 2014, U.S. Appl. No. 13/226,578, "Optical Casing Collar Locator Systems and Methods," filed Sep. 7, 2011, 11 pgs.

* cited by examiner

OPTICAL CASING COLLAR LOCATOR SYSTEMS AND METHODS

CROSS-REFERENCE TO RELATED APPLICATIONS

This application is a continuation-in-part of pending U.S. patent application Ser. No. 13/226,578, titled "Optical casing collar locator systems and methods" and filed Sep. 7, 2011 by inventors John Maida and Etienne Samson. The parent application is hereby incorporated herein by reference.

BACKGROUND

After a wellbore has been drilled, the wellbore typically is cased by inserting lengths of steel pipe ("casing sections") connected end-to-end into the wellbore. Threaded exterior rings called couplings or collars are typically used to connect adjacent ends of the casing sections at casing joints. The result is a "casing string" including casing sections and connecting collars that extends from the surface to a bottom of the wellbore. The casing string is then cemented in place to complete the casing operation.

After a wellbore is cased, the casing is often perforated to provide access to a desired formation, e.g., to enable formation fluids to enter the well bore. Such perforating operations require the ability to position a tool at a particular and known position in the well. One method for determining the position of the perforating tool is to count the number of collars that the tool passes as it is lowered into the wellbore. As the length of each of the steel casing sections of the casing string is known, correctly counting a number of collars or joints traversed by a device as the device is lowered into a well enables an accurate determination of a depth or location of the tool in the well. Such counting can be accomplished with a casing collar locator ("CCL"), an instrument that may be attached to the perforating tool and suspended in the wellbore with a wireline.

A wireline is an armored cable having one or more electrical conductors to facilitate the transfer of power and communications signals between the surface electronics and the downhole tools. Such cables can be tens of thousands of feet long and subject to extraneous electrical noise interference and crosstalk. In certain applications, the detection of signals from conventional casing collar locators may not be reliably communicated via the wireline.

BRIEF DESCRIPTION OF THE DRAWINGS

A better understanding of the various disclosed embodiments can be obtained when the detailed description is considered in conjunction with the attached drawings, in which.

Figure 1:
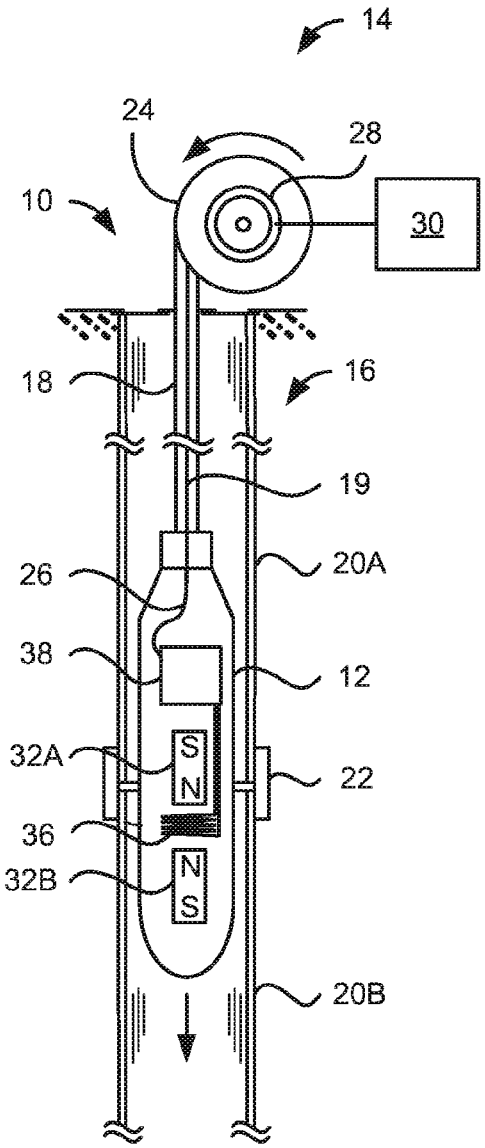
FIG. 1 is a side elevation view of a well having a casing collar locator (CCL) system in accordance with certain illustrative embodiments.

While the invention is susceptible to various alternative forms, equivalents, and modifications, specific embodiments thereof are shown by way of example in the drawings and will herein be described in detail. It should be understood, however, that the drawings and detailed description thereto do not limit the disclosure, but on the contrary, they provide the foundation for alternative forms, equivalents, and modifications falling within the scope of the appended claims.

DETAILED DESCRIPTION

The problems outlined above are at least in part addressed by casing collar locator (CCL) systems and methods that provide optical detection signals. In at least some embodiments, the casing collar locator system includes a sonde configured to be conveyed through a casing string by a fiber optic cable. The sonde includes at least one permanent magnet producing a magnetic field that changes in response to passing a collar in the casing string, a coil that receives at least a portion of the magnetic field and provides an electrical signal in response to the changes in the magnetic field, and a light source that responds to the electrical signal to communicate light along an optical fiber to indicate passing collars. Methods for using the sonde to locate casing collars in the casing string are also described.

Turning now to the figures, FIG. 1 is a side elevation view of a well 10 in which a sonde 12 of a casing collar locator system 14 is suspended in a casing string 16 of the well 10 by a fiber optic cable 18. The casing string 16 includes multiple tubular casing sections 20 connected end-to-end via collars. FIG. 1 specifically shows two adjacent casing sections 20A and 20B connected by a collar 22. As is typical, the casing sections 20 of the casing string 16 and the collars connecting the casing sections 20 (e.g., the collar 22) are made of steel, an iron alloy. We note here that the steel is a ferromagnetic material with a relatively high magnetic permeability and a relatively low magnetic reluctance, so it conveys magnetic lines of force much more readily than air and certain other materials.

In the embodiment of FIG. 1, the fiber optic cable 18 includes at least one optical fiber 19 and preferably also includes armor to add mechanical strength and/or to protect the cable from shearing and abrasion. Additional optical fibers and/or electrical conductors may be included if desired. Such additional fibers can, if desired, be used for power transmission, communication with other tools, and redundancy. The fiber optic cable 18 spools to or from a winch 24 as the sonde 12 is conveyed through the casing string 16. The reserve portion of the fiber optic cable 18 is wound around a drum of the winch 24, and the fiber optic cable 18 is dispensed or unspooled from the drum as the sonde 12 is lowered into the casing string 16.

In the illustrated embodiment, the winch 24 includes an optical slip ring 28 that enables the drum of the winch 24 to rotate while making an optical connection between the optical fiber 19 and a fixed port of the slip ring 28. A surface unit 30 is connected to the port of the slip ring 28 to send and/or receive optical signals via the optical fiber 19. In other embodiments, the winch 24 includes an electrical slip ring 28 to send and/or receive electrical signals from the surface unit 30 and a drum-mounted electro-optical interface that translates the signals from the optical fiber for communication via the slip ring and vice versa.

The sonde 12 includes an optical fiber 26 coupled to the optical fiber 19 of the fiber optic cable 18. The surface unit 30 receives signals from the sonde 12 via the optical fibers 19 and 26, and in at least some embodiments transmits signals to the sonde via the optical fibers 19 and 26. When the sonde 12 passes a collar in the casing string 16 (e.g. the collar 22), the sonde communicates this event to the surface unit 30 via the optical fibers 19 and 26.

In the embodiment of FIG. 1, the sonde 12 also includes a pair of permanent magnets 32A and 32B, a coil of wire (i.e., a coil) 36 having multiple windings, and a signal transformer 38 positioned in a protective housing. The permanent magnet 32 has north and south poles aligned along a central axis of the sonde 12. The coil 36 is positioned between the magnets 32A and 32B. The windings of the coil 36 may be, for example, wound around a bobbin.

In the embodiment of FIG. 1, each of the magnets 32A and 32B is cylindrical and has a central axis. Each of the magnets 32A and 32B has two opposed ends, and the central axis extends between the two ends. A magnetic north pole is located at one of the ends, and a magnetic south pole is located at the other end. The magnets 32A and 32B are positioned on opposite sides of the coil 36 such that their central axes are collinear, and the north magnetic poles of the magnets 32A and 32B are adjacent one another and the coil 36. A central axis of the coil 36 is collinear with the central axes of the magnets 32A and 32B. The coil 36 has two ends connected to the signal transformer 38. The signal transformer 38 is coupled to the optical fiber 26, and communicates with the surface unit 30 via the optical fiber 26 of the sonde 12 and the optical fiber 19 of the fiber optic cable 18.

The magnets 32A and 32B both produce magnetic fields that pass or "cut" through the windings of the coil 36. The magnet 32A and the adjacent walls of the casing string 16 form a first magnetic circuit through which most of the magnetic field produced by the magnet 32A passes. Similarly, the magnetic field produced by the magnet 32B passes through a second magnetic circuit including the magnet 32B and the adjacent walls of the casing string 16. The intensities of the magnetic fields produced by the magnets 32A and 32B depend on the sums of the magnetic reluctances of the elements in each of the magnetic circuits. Any change in the intensities of the magnetic field produced by the magnet 32A and/or the magnetic field produced by the magnet 32B cutting through the coil 36 causes an electrical voltage to be induced between the two ends of the coil 36 (in accordance with Faraday's Law of Induction).

As the sonde 12 of FIG. 1 passes through a casing section of the casing string 16 (e.g., the casing section 20A), the intensities of the magnetic fields produced by the magnets 32A and 32B and cutting through the coil 36 remain substantially the same, and no appreciable electrical voltage is induced between the two ends of the coil 36. On the other hand, as the sonde 12 passes by a collar (e.g., the collar 22), the magnetic reluctance of the casing string 16 changes, causing the intensities of the magnetic fields produced by the magnets 32A and 32B and cutting through the coil 36 to change, and an electrical voltage to be induced between the two ends of the coil 36. The signal transformer 38 receives the voltage produced by the coil 36, and responsively communicates with the surface unit 30 via the optical fiber 26 (and the optical fiber 19 of the fiber optic cable 18).

Figure 2:
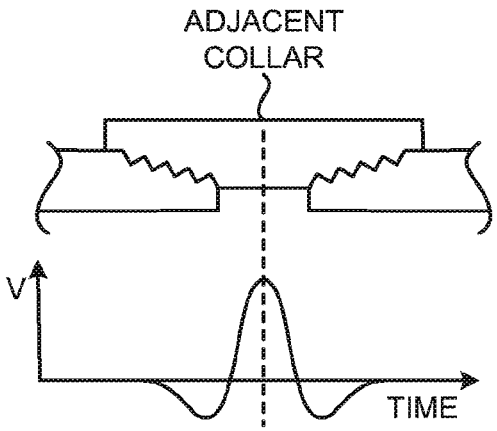
FIG. 2 includes an illustrative diagram of a collar in a casing string and a corresponding illustrative graph of a voltage induced between ends of a coil.

FIG. 2 includes an illustrative diagram of a collar of a casing string (e.g., the collar 22 of the casing string 16 FIG. 1), and an illustrative graph of an electrical voltage 'V' induced between the two ends of the coil 36 of FIG. 1 when the sonde 12 of FIG. 1 passes the collar. The voltage signal produced between the ends of the coil 36 is dependent upon the rate at which the sonde 12 moves past the collar. In FIG. 2, the sonde 12 moves at a relatively slow rate past the collar. In the embodiment of FIG. 2, the voltage first takes a relatively small excursion from a nominal level in a negative direction as the sonde 12 approaches the collar, then takes a relatively large excursion from the nominal level in a positive direction as the sonde 12 is adjacent the collar, then takes another relatively small excursion from the nominal level in the negative direction as the sonde 12 moves past the collar. The changes in the intensities of the magnetic fields produced by the magnets 32A and 32B thus appear as a positive and negative voltage peaks between the ends of the coil 36 as the sonde 12 approaches, is adjacent to, and moves past the collar. The signal transformer 38 converts the positive and/or the negative voltage peaks to an optical signal for communication to the surface unit 30. The voltage signal shown in the graph allows precise detection of the center of the collar.

Other configurations of the sonde 12 exist and may be employed. Any arrangement of magnet(s) and/or coil(s) that offers the desired sensitivity to passing casing collars can be used.

Figure 3:
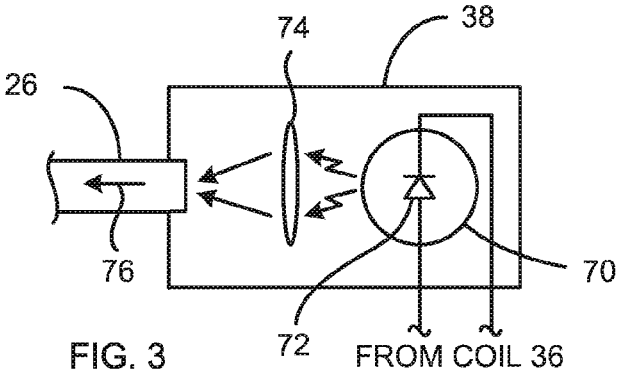
FIGS. 3-7 show different illustrative signal transformer embodiments.

Signal transformer 38 can take a variety of forms. FIG. 3 is a diagram of one illustrative embodiment which includes a light source 70 coupled to the ends of the coil 36 and producing light when a voltage exists between ends of the coil 36. The illustrated light source 70 includes a light emitting diode (LED) 72. Other suitable light sources include, without limitation, semiconductor diode lasers, and superluminescent diodes. The signal transformer 38 also includes a lens 74 that directs at least some of the light produced by the light source 70 into an end of the optical fiber 26 positioned in the signal transformer 38. The LED 72 is energized by a voltage peak (e.g., a positive voltage peak). As the sonde 12 moves past a casing collar, the LED 72 sends a light pulse 76 along the optical fiber to the surface unit 30. This signal transformer embodiment may be advantageous in that it does not require surface unit 30 to provide an optical signal from the surface.

Where an LED is employed, it may be operated in the very low-power regime (20-100 microamps) to keep the diode near ambient temperature. Due to quantum effects, the LED will generally still radiate sufficient photons for reliable communication with the surface electronics.

Figure 4:
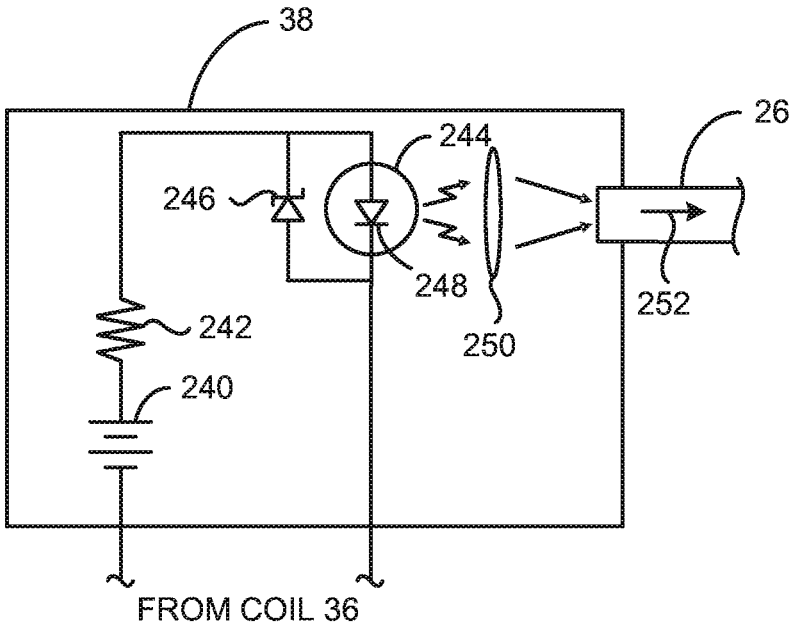

FIG. 4 is a diagram of another illustrative embodiment of the signal transformer 38 of FIG. 1. In the embodiment of FIG. 4, the signal transformer 38 includes a voltage source 240, a resistor 242, a light source 244, and a Zener diode 246. The illustrated light source 244 includes an LED 248. The voltage source 240, the resistor 242, the LED 248, and the coil 36 (see FIG. 1) are connected in series, forming a series circuit. Those of ordinary skill in the art will recognize that the arrangement of electrical elements in a series circuit can generally be varied without affecting operability. The illustrated voltage source 240 is a direct current (DC) voltage source having two terminals, and one of the two terminals of the voltage source 240 is connected to one end of the coil 36 (see FIG. 1). In the embodiment of FIG. 4, the LED 248 has two terminals, one of which is connected to the other of the two ends of the coil 36. The resistor 242 is connected between the voltage source 240 and the LED 248. The resistor 242 limits a flow of electrical current through the LED 248.

The voltage source 240 produces a DC bias voltage that improves the responsiveness of the light source 244. The voltage source 240 may be or include, for example, a chemical battery, a fuel cell, a nuclear battery, an ultra-capacitor, or a photovoltaic cell (driven by light received from the surface via an optical fiber). In some embodiments, the voltage source 240 produces a DC bias voltage that causes an electrical current to flow through the series circuit including the voltage source 240, the resistor 242, the LED 248, and the coil 36 (see FIG. 1), and the current flow through the LED 248 causes the LED 248 to produce light. An optional lens 250 directs some of the light produced by the LED 248 into an end of the optical fiber 26 (see FIG. 1) as light 252. The light 252 propagates along the optical fiber 26 to the surface unit 30 (see FIG. 1). The surface unit 30 detects changes the light 252 received via the optical fiber 26 to determine positions of casing collars in the casing string. In some embodiments, the light 252 produced by the signal transformer 38 has an intensity that varies linearly about the bias point in proportion to an electrical signal produced between the ends of the coil 36.

As the sonde 12 (see FIG. 1) moves past a casing collar, the changes in the strength of the magnetic field passing through the coil 36 (see FIG. 1) induce positive and negative voltage pulses between the ends of the coil 36 (see FIG. 2). Within the series circuit including the voltage source 240, the resistor 242, the LED 248, and the coil 36, the voltage pulses produced between the ends of the coil 36 are summed with the DC bias voltage produced by the voltage source 240. In some embodiments, a positive voltage pulse produced between the ends of the coil 36 causes a voltage across the LED 248 to increase, and the resultant increase in current flow through the LED 248 causes the LED 248 to produce more light (i.e., light with a greater intensity). Similarly, a negative voltage pulse produced between the ends of the coil 36 causes the voltage across the LED 248 to decrease, and the resultant decrease in the current flow through the LED 248 causes the LED 248 to produce less light (i.e., light with a lesser intensity). In these embodiments, the DC bias voltage produced by the voltage source 240 causes the light 252 produced by the signal transformer 38 to have an intensity that is proportional to the voltage signal produced between the ends of the coil 36.

The Zener diodes 246 is connected between the two terminals of the LED 248 to protect the LED 248 from excessive forward voltages. Other circuit elements for protecting the light source against large voltage excursions are known and may also be suitable. In some embodiments, the light source 244 may be or include, for example, an incandescent lamp, an arc lamp, a semiconductor laser, or a superluminescent diode. The DC bias voltage produced by the voltage source 240 may match a forward voltage threshold of one or more diodes in series with the light source 244.

Figure 5:
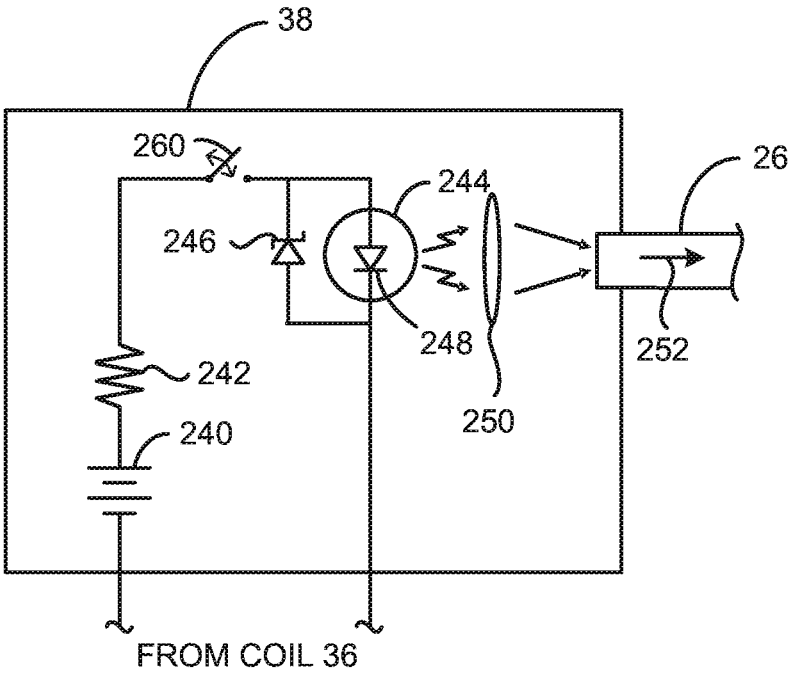

FIG. 5 is a diagram of another alternative embodiment of the signal transformer 38 of FIG. 4 including a switch 260 in the series circuit including the voltage source 240, the resistor 242, the LED 248, and the coil 36 (see FIG. 1). Elements shown in previous figures and described above are labeled similarly in FIG. 5. When the switch 260 is closed, current may flow through the series circuit. When the switch 260 is open, current cannot flow through the series circuit, and the LED 248 does not produce light. The switch 260 may be operated to conserve electrical energy stored in the voltage source 240. For example, the switch 260 may be opened when the sonde 12 (see FIG. 1) is not in use, and/or when the sonde 12 is not at a desired location within a casing string.

In some embodiments, the switch 260 may be opened and closed at a relatively high rate, for example between 50 and 5,000 times (cycles) per second. The ratio of the amount of time that the switch 260 is closed during each cycle to the total cycle time (i.e., the duty cycle) of the switch 260 may also be selected to conserve electrical energy stored in the voltage source 240.

Figure 6:
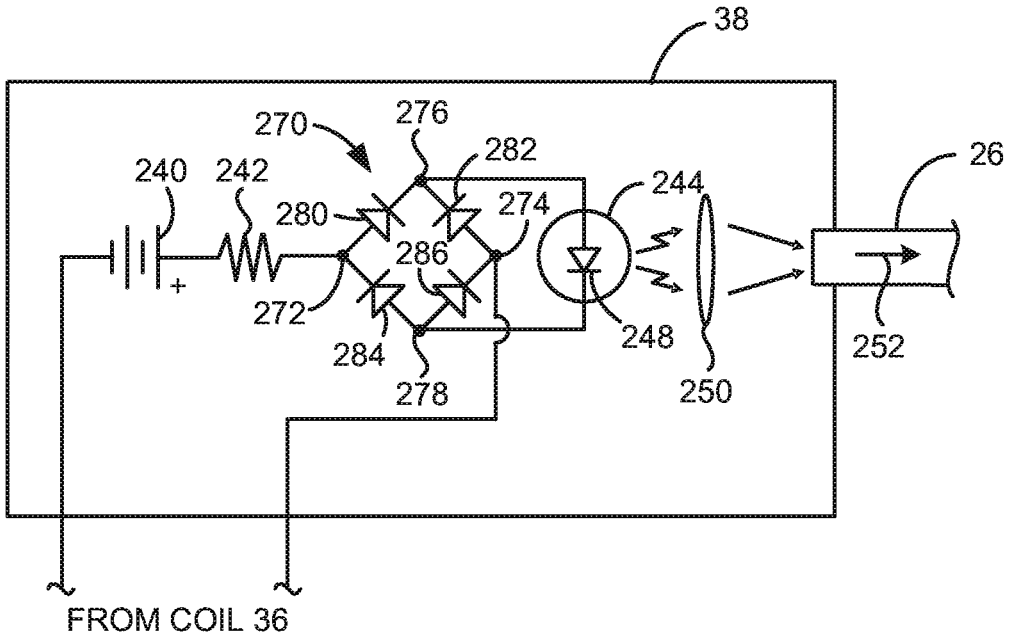

FIG. 6 is a diagram of another illustrative embodiment of the signal transformer 38 of FIG. 1. Elements shown in previous figures and described above are labeled similarly in FIG. 6. In the embodiment of FIG. 6, the signal transformer 38 includes the voltage source 240, the resistor 242, a diode bridge 270, and the light source 244 including the LED 248. The diode bridge 270 includes a pair of input nodes 272 and 274, a pair of output nodes 276 and 278, and four diodes 280, 282, 284, and 286. The diode 280 is connected between the input node 272 and the output node 276. The diode 280 is connected between the input node 272 and the output node 276. The diode 282 is connected between the input node 274 and the output node 276. The diode 284 is connected between the output node 278 and the input node 272. The diode 286 is connected between the output node 278 and the input node 274.

In the embodiment of FIG. 6, one end of the coil 36 is connected to one terminal of the voltage source 240, and the other end of the coil 36 is connected to the input node 274 of the diode bridge 270. The resistor 242 is connected between the other terminal of the voltage source 240 and the input node 272 of the diode bridge 270. The two terminals of the LED 248 are connected to the output nodes 276 and 278 of the diode bridge 270.

As the sonde 12 (see FIG. 1) moves past a casing collar, the changes in the strength of the magnetic field passing through the coil 36 (see FIG. 1) induce positive and negative voltage pulses between the ends of the coil 36 (see FIG. 2). The diode bridge 270 provides a rectified version of the electrical signal from the coil 36 (see FIG. 1) to the LED 248.

In the embodiment of FIG. 6, the positive and negative voltage pulses induced between the ends of the coil 36 (see FIG. 2) are applied to the input nodes 272 and 274 of the diode bridge 270 via the voltage source 240 and the resistor 242. The voltage source 240 overcomes at least a portion of the voltage drop of the diodes 280 and 286 of the diode bridge 270, favoring voltage pulses induced between the ends of the coil 36 that cause current to flow through the diodes 280 and 286. As a result, the LED 248 produces more light for voltage pulses between the ends of the coil 36 that cause current to flow through the diodes 280 and 286 than for voltage pulses between the ends of the coil 36 that cause current to flow through the diodes 282 and 284.

In some embodiments, the voltage source 240 produces a DC bias voltage that causes a current to flow through the resistor 242, the diode 280 of the diode bridge 270, the LED 248, the diode 286 of the diode bridge 270, and the coil 36 (see FIG. 1). The resultant current flow through the LED 248 causes the LED 248 to produce light.

In other embodiments, the ends of the coil 36 (see FIG. 1) are connected to the input nodes 272 and 274 of the diode bridge 270, and the voltage source 240 and the resistor 242 are connected in series with the LED 248 between the output nodes 276 and 278 of the diode bridge 270. In these embodiments, the light 252 produced by the signal transformer 38 has an intensity that is proportional to an absolute value of a magnitude of an electrical signal produced between the ends of the coil 36. The diode bridge 270 may be considered to perform an operation on the voltage pulses similar to an absolute value function. When a positive voltage pulse is produced between the ends of the coil 36 and applied to the input nodes 272 and 274 of the diode bridge 270, the positive pulse is reproduced between the output nodes 276 and 278 (minus diode losses). When a negative voltage pulse is produced between the ends of the coil 36 and applied between the input nodes 272 and 274, the negative voltage pulse is inverted and reproduced as a positive voltage pulse between the output nodes 276 and 278 (minus diode losses). The (always positive) voltage pulses produced between the output nodes 276 and 278 of the diode bridge 270 are summed with the DC bias voltage produced by the voltage source 240. Accordingly, both positive and negative voltage pulses produced between the ends of the coil 36 cause a voltage across the LED 248 to increase, and the resultant increase in current flow through the LED 248 causes the LED 248 to produce more light (i.e., light with a greater intensity). The light 252 produced by the signal transformer 38 has an intensity that is proportional to an absolute value of a magnitude of an electrical signal produced between the ends of the coil 36.

Figure 7:
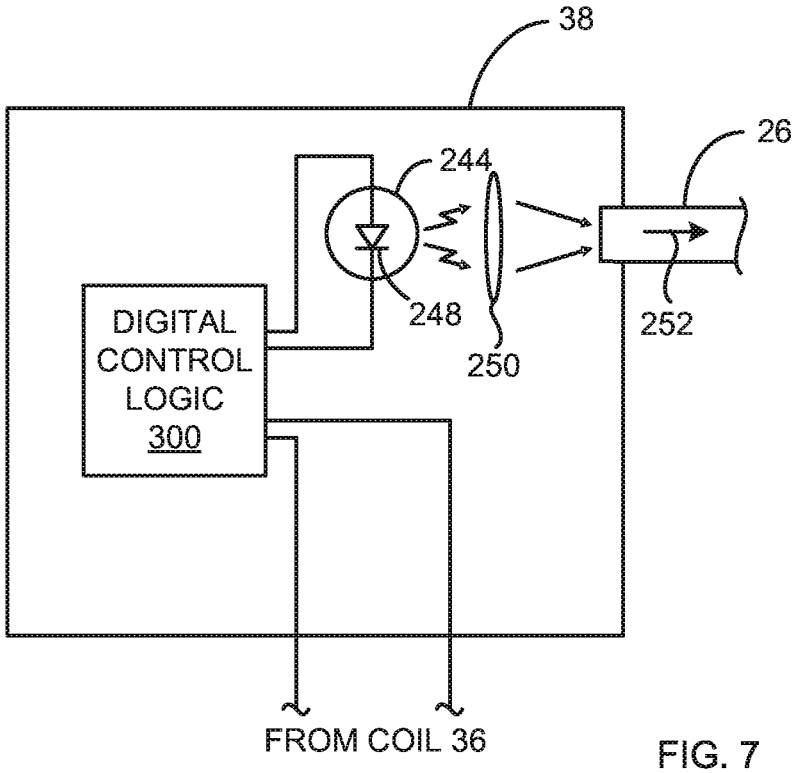

FIG. 7 is a diagram of another illustrative embodiment of the signal transformer 38 of FIG. 1. Elements shown in previous figures and described above are labeled similarly in FIG. 7. In the embodiment of FIG. 7, the signal transformer 38 includes a digital control logic 300 coupled to the coil 36 (see FIG. 1) and to the light source 244 including the LED 248. The digital control logic 300 receives an electrical signal produced between the ends of the coil 36, and controls the LED 248 dependent upon the electrical signal.

In some embodiments, the light 252 produced by the signal transformer 38 has an intensity that is (approximately) proportional to a magnitude of an electrical signal produced between the ends of the coil 36. For example, the digital control logic 300 may control the LED 248 such that the LED 248 produces a first amount of light (i.e., light with a first intensity) when the voltage between the ends of the coil 36 is substantially zero, a second amount of light (i.e., light with a second intensity) that is greater than the first amount/intensity when a positive voltage pulse is produced between the ends of the coil 36, and a third amount of light (i.e., light with a third intensity) that is less than the first amount/intensity when a negative voltage pulse is produced between the ends of the coil 36.

In some embodiments, the digital control logic 300 may control the LED 248 dependent upon one or more stored threshold voltage values. For example, a first threshold voltage value may be a positive voltage value that is less than an expected positive peak value, and a second threshold value may be a negative voltage value that is less than an expected negative peak value. The digital control logic 300 may control the LED 248 such that the LED 248 produces the first amount of light (i.e., the first light intensity) when the voltage between the ends of the coil 36 is between the first threshold voltage value and the second threshold voltage value, the second amount of light (i.e., the second light intensity) when the voltage between the ends of the coil 36 is greater than the first threshold voltage value, and the third amount of light (i.e., the third light intensity) when the voltage between the ends of the coil 36 is greater than (more negative than) the second threshold voltage.

In other embodiments, the digital control logic 300 may control the LED 248 such that a pulse rate of light produced by the LED 248 is dependent the electrical signal from the coil 36. For example, the digital control logic 300 may control the LED 248 such that the LED 248 produces light: (i) at a first pulse rate when the voltage between the ends of the coil 36 is between the first threshold voltage value and the second threshold voltage value, (ii) at a second pulse rate when the voltage between the ends of the coil 36 is greater than the first threshold voltage value, and (iii) at a third pulse rate when the voltage between the ends of the coil 36 is greater than (more negative than) the second threshold voltage.

In other embodiments, the digital control logic 300 may control the LED 248 such that durations of light pulses produced by the LED 248 are dependent on the electrical signal from the coil 36. For example, the digital control logic 300 may control the LED 248 such that the LED 248 produces light pulses having: (i) a first duration when the voltage between the ends of the coil 36 is between the first threshold voltage value and the second threshold voltage value, (ii) a second duration when the voltage between the ends of the coil 36 is greater than the first threshold voltage value, and (iii) a third duration when the voltage between the ends of the coil 36 is greater than (more negative than) the second threshold voltage.

Figure 8:
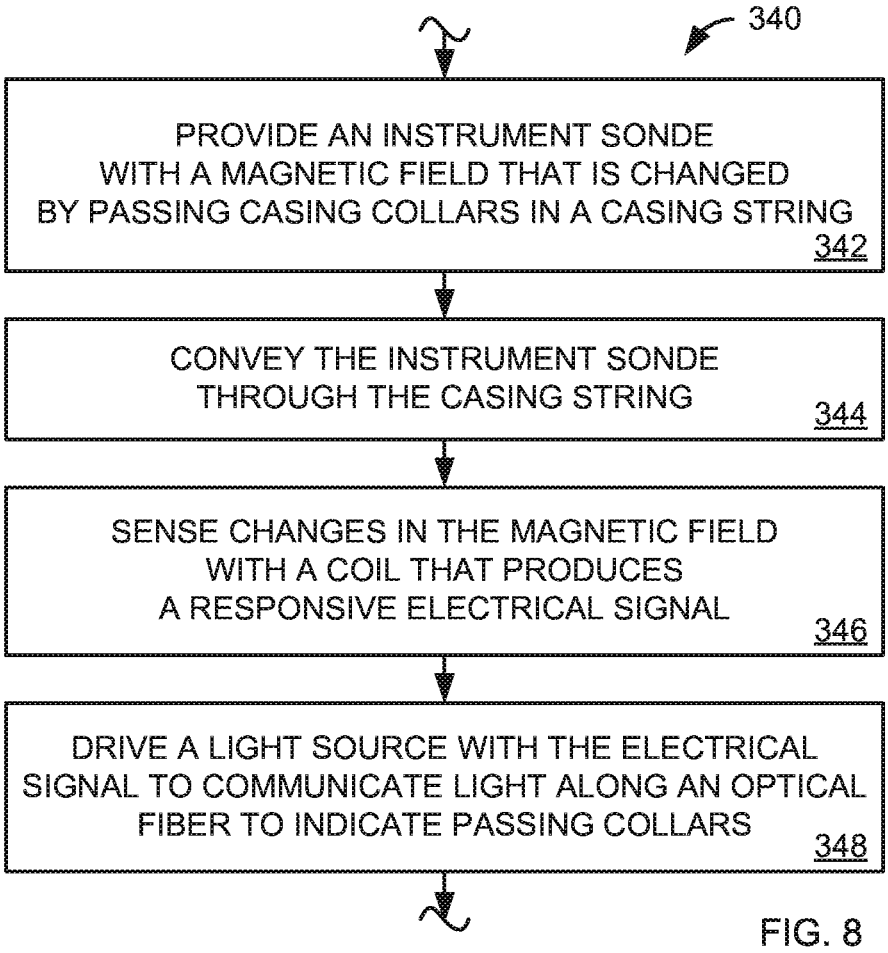
FIG. 8 is a flowchart of a casing collar locator method.

FIG. 8 is a flowchart of an illustrative casing collar locator method 340 that may be carried out by the casing collar locator system 14 (see FIG. 1). As represented by block 342, the method includes providing an instrument sonde (e.g., the sonde 12 of FIG. 1) with a magnetic field that is changed by passing casing collars in a casing string. The method 340 further includes conveying the instrument sonde through the casing string, as represented by block 344. The length of the wireline cable may be monitored as the sonde is lowered into, or pulled out of, the casing string.

The method 340 further includes sensing changes in the magnetic field with a coil (e.g., the coil 36 of FIG. 1) that produces a responsive electrical signal, as represented by the block 346. In some embodiments, the changes in the magnetic field produce changes in a voltage between two ends of the coil. The method 340 further includes driving a light source with the electrical signal to communicate light along an optical fiber (e.g., the optical fiber 26 of FIG. 1) to indicate passing collars, as represented by the block 348. The light source may include, for example, an incandescent lamp, an arc lamp, an LED, a semiconductor laser, or a superluminescent diode. As described above, the light source may be switched on and off (i.e., may be pulsed) to reduce electrical power consumption.

In some embodiments, the electrical signal produced by the coil is biased with a voltage source to improve a responsiveness of the light source. In some embodiments, the biasing causes the light source to adjust the communicated light in proportion to a change in the electrical signal. The biasing may, for example, match a forward voltage threshold of one or more diodes in series with the light source.

The method 340 may also include detecting changes in light at the surface to determine positions of the collars. For example, the changes in the light, such as changes in intensity or pulse rate or pulse duration, may be monitored (e.g., by the surface unit 30 of FIG. 1) to determine the location of casing collars in the casing string. The current wireline length from block 344 may be stored as a tentative casing collar location when the presence of a casing collar is detected in this block.

Numerous variations and modifications will become apparent to those skilled in the art once the above disclosure is fully appreciated. For example, the components of a series circuit can be re-ordered. As another example, the foregoing description discloses a wireline embodiment for explanatory purposes, but the principles are equally applicable to, e.g., a tubing-conveyed sonde with an optical fiber providing communications between the sonde and the surface. It is intended that the following claims be interpreted to embrace all such variations and modifications.

What is claimed is:

1. A casing collar locator system that comprises:

a sonde configured to be conveyed through a casing string, wherein the sonde comprises:

at least one permanent magnet producing a magnetic field that changes in response to passing a collar in the casing string;

a coil that receives at least a portion of the magnetic field and provides an electrical signal in response to said changes in the magnetic field; and a voltage source, a switch, and a light source in series with the coil, when the switch is closed, the light source responds to said electrical signal to communicate light along an optical fiber to indicate passing collars, wherein said switch is opened and closed at a duty cycle that conserves energy stored in the voltage source.

2. The system of claim 1, further comprising a surface unit that detects changes in light received via the optical fiber to determine positions of the collars.

3. The system of claim 1, wherein the light source comprises at least one of: an incandescent lamp, an arc lamp, an LED, a semiconductor laser, and a superluminescent diode.

4. The system of claim 1, wherein the voltage source biases the electrical signal to improve responsiveness of the light source.

5. The system of claim 4, wherein the voltage source is in the set consisting of a chemical battery, a fuel cell, a nuclear battery, an ultra-capacitor, and a photovoltaic cell.

6. The system of claim 4, wherein the voltage source matches a forward-voltage threshold of one or more diodes in series with the light source.

7. The system of claim 4, wherein the voltage source bias makes the light source adjust the communicated light in proportion to a change in the electrical signal.

8. The system of claim 1, wherein the light source adjusts intensity of the communicated light in response to changes in the electrical signal.

9. The system of claim 1, wherein the light source adjusts duration or rate of light pulses in response to changes in the electrical signal.

10. The system of claim 1, further comprising a diode bridge that provides a rectified version of the electrical signal to the light source.

11. The system of claim 1, further comprising a current limiting resistor in series with the light source.

12. The system of claim 1, further comprising a Zener diode to protect the light source against excess reverse voltage.

13. The system of claim 1, wherein the light source comprises an LED that is operated in a very low-power regime.

14. A casing collar locator method that comprises:

providing an instrument sonde with a magnetic field that is changed by passing casing collars in a casing string;

conveying the instrument sonde through the casing string;

sensing changes in the magnetic field with a coil that produces a responsive electrical signal; and operating a switch for a light source in series with the switch, the coil, and a voltage source, wherein, when the switch is closed, the electrical signal causes the light source to communicate light along an optical fiber to indicate passing collars, wherein the switch is operated at a duty cycle that conserves energy stored in the voltage source.

15. The method of claim 14, further comprising detecting changes in light at the surface to determine positions of the collars.

16. The method of claim 14, wherein the light source comprises at least one of: an incandescent lamp, an arc lamp, an LED, a semiconductor laser, and a superluminescent diode.

17. The method of claim 14, further comprising biasing the electrical signal with the voltage source to improve responsiveness of the light source.

18. The method of claim 17, wherein said biasing matches a forward-voltage threshold of one or more diodes in series with the light source.

19. The method of claim 17, wherein said biasing makes the light source adjust the communicated light in proportion to a change in the electrical signal.

20. The method of claim 14, further comprising adjusting duration or rate of light pulses in response to changes in the electrical signal.

21. The method of claim 14, further comprising operating the light source in a very low-power regime, wherein the light source comprises an LED.

* * * * *